US005181613A

United States Patent [19]

Wright

[11] Patent Number: 5,181,613

[45] Date of Patent: Jan. 26, 1993

[54] PEDI PAN

[76] Inventor: Bruce A. Wright, 138 Roy Thomason Rd., Simpsonville, S.C. 29681

[21] Appl. No.: 686,409

[22] Filed: Apr. 17, 1991

[51] Int. Cl.[5] ..... B65D 1/34

[52] U.S. Cl. ..... 206/567

[58] Field of Search ..... 206/557-567, 206/496

[56] References Cited

U.S. PATENT DOCUMENTS 1,745,606 2/1930 Densmore et al. ..... 206/558

FOREIGN PATENT DOCUMENTS 941342 2/1974 Canada ..... 206/557

*Primary Examiner*—William I. Price

*Attorney, Agent, or Firm*—John P. Halvonik

[57] ABSTRACT

The invention relates to a receptacle to be used in the manicuring and cutting of the fingernails and toenails. The pedi pan of the present invention comprises a specially shaped tray with open sides and sponge rubber base to provide a gripping surface for the pan.

5 Claims, 1 Drawing Sheet

PEDI PAN

BACKGROUND OF THE INVENTION

1. Field of the Invention

The invention relates to the manicuring field, and in particular to a specially designed pan that allows one to catch the finger and toenails as they are cut.

2. Description of the Prior Art

While there are pans for various purposes in the prior art, none that applicant is aware of are designed for catching the fingernails and toenails as they are cut.

SUMMARY OF THE INVENTION

The ped pan of the present invention comprises a pan with specially shaped sides that are curved outward from the interior of the pan to catch finger and toenail debris as the nails are cut. The invention is placed underneath the foot or hand as it is held for cutting. The underside of the pan has a sponge rubber pad to keep the pan from moving when one's foot is placed in it.

It is the object of this invention to provide a container for catching the cuttings of nails.

Another objective of the invention is to provide a nail debris holder that remains stationary while in use.

Yet another objective of the invention is to provide a nail catching surface that can be supported underneath the hand or foot and catch debris as nails are polished.

Other advantages of the invention should be readily apparent to those skilled in the art once the invention has been described.

DESCRIPTION OF THE PREFERRED EMBODIMENT

The pedi pan of the present invention may be made of any suitable material that forms a reasonably sturdy pan for use with feet and hands. Polyurethane is the preferred material but aluminum, cardboard, and wood are other readily available materials that come to mind.

The pan itself is of substantially rectangular construction having three walls attached to a support surface.

There are two side walls 1 and 2 and a front wall 3 so that one end of the rectangular construction is open to allow the placement of the foot or hand.

Figure 1:
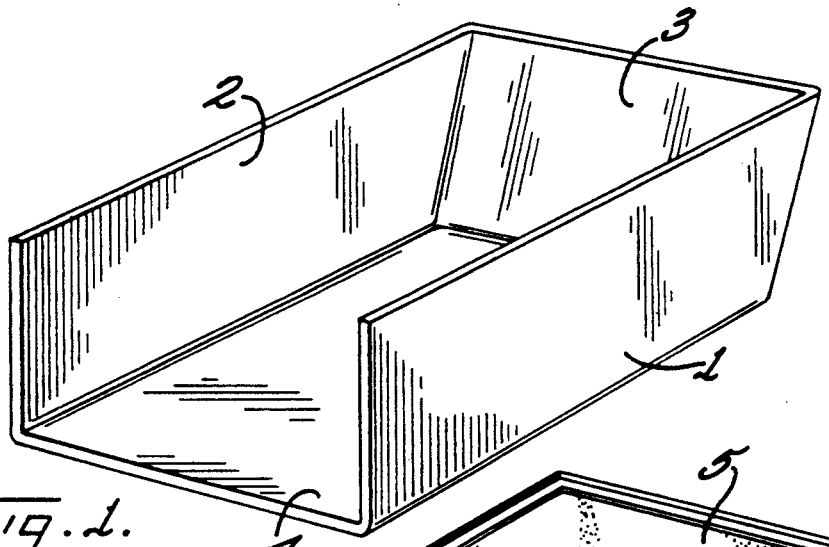
FIG. 1 overall view of the construction of the pedi pan
Figure 2:
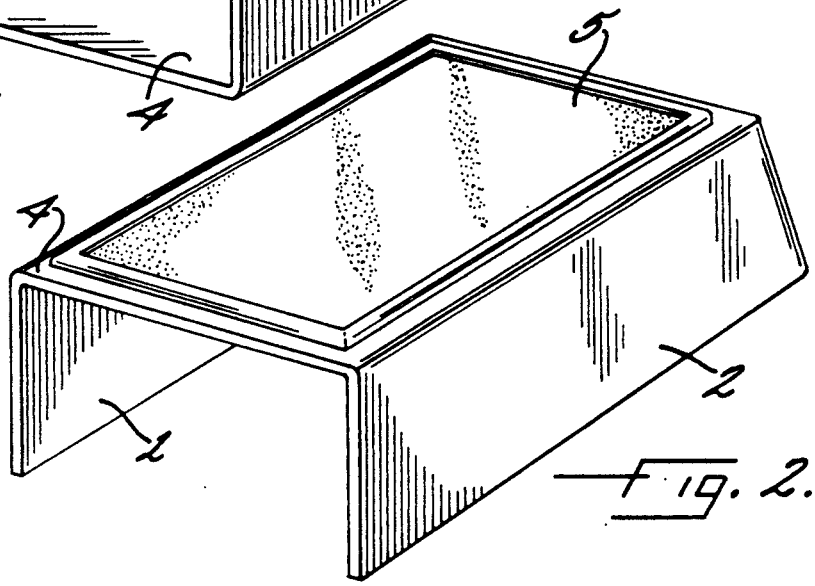
FIG. 2 shows a side view and rear view of the pedi pan.
Figure 3:
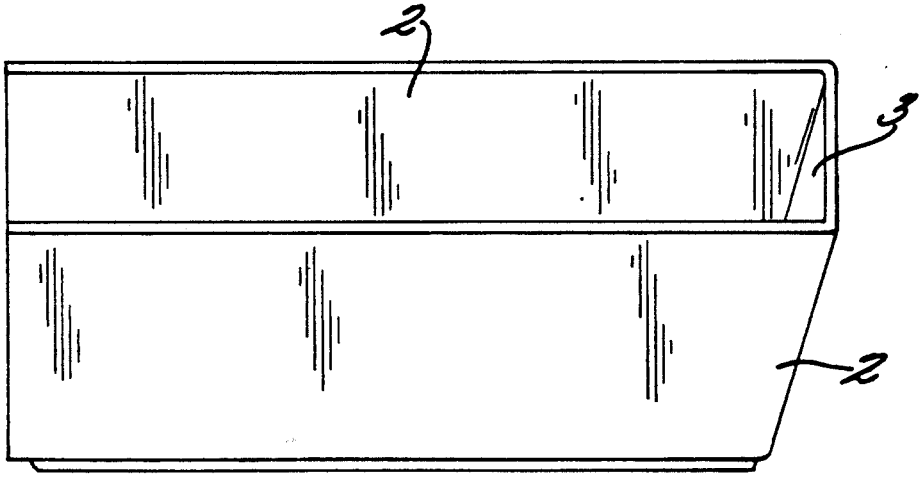

Preferably the front and side walls are angled outward (see FIG. 3) to assist in the catching of the nails and other debris as the nails are cut. Since the nails, etc. may bounce around once they are cut, it helps to angle the walls to assist in this. The preferred angle for these walls would be 70 degrees from vertical.

The pedi pan offers a convenient receptacle that can be held under the foot or hand in which to catch the nails and other debris from toe nails and finger nails as they are cut.

The bottom wall 4 of the pan has a piece of sponge material 5 or other gripping material attached to the underside. Suitable materials may be eg.: Styrofoam, polyurethane, sponge rubber, etc. The material should be one that can provide a relatively frictional engagement with the surface that the pan is on. This may be eg.: a foot stand, etc. When one places his foot or hand in the pan the frictional piece will aid in keeping the pan stationary. The material may be glued or otherwise attached to the underside.

The preferred dimensions of the pan would be about 12 inches by 6 inches with wall about 2 inches high. The walls should be along three sides of the base with one open side.

I claim:

1. A manicuring pan for catching fingernails and toenails and other debris as nails are cut comprising: pan having bottom surface and front walls and two side walls so as to form a generally rectangular shaped pan with an open side, the underside of said bottom surface having a frictional member so as to keep said pan steady while in use.

2. The apparatus of claim 1 wherein said frictional member is a sponge rubber material.

3. The apparatus of claim 2 wherein said side walls and said front wall are angled outward at an about 70 degree angle.

4. The apparatus of claim 3 wherein said pan has dimensions of about 12 by 6 inches with walls having a height of about 2 inches.

5. The apparatus of claim 4 wherein said pan is made of polyurethane.

* * * * *